United States Patent [19]

Gray

[11] Patent Number: 4,718,670

[45] Date of Patent: Jan. 12, 1988

[54] LINE FAULT DETECTOR BALL

[76] Inventor: George S. Gray, 191 N. Parade, Mount Druitt, New South Wales, Australia

[21] Appl. No.: 779,377

[22] Filed: Sep. 23, 1985

Related U.S. Application Data

[62] Division of Ser. No. 519,772, Jun. 30, 1983, Pat. No. 4,664,376.

[30] Foreign Application Priority Data

Aug. 10, 1982 [AU] Australia ..... PF5307

[51] Int. Cl.[4] ..... A63B 39/00; A63B 39/02

[52] U.S. Cl. ..... 273/61 R; 273/58 G

[58] Field of Search ..... 273/61 R, 61 A, 61 E, 273/58 G, 58 H, 199 A, 58 B, 58 BA, 167 H, 29 R

[56] References Cited

U.S. PATENT DOCUMENTS

| | | | |
|---|---|---|---|
| 818,050 | 4/1906 | Ritchie | 273/58 BA |
| 2,219,074 | 10/1940 | Guillou | 273/61 A |
| 3,082,510 | 3/1963 | Kelly et al. | 273/58 B |
| 3,774,194 | 11/1973 | Jokay et al. | 273/61 R |
| 4,300,767 | 11/1981 | Reed et al. | 273/61 R |
| 4,313,607 | 2/1982 | Thompson | 273/167 H |
| 4,375,289 | 3/1983 | Schmall et al. | 273/29 R |

FOREIGN PATENT DOCUMENTS

| | | | |
|---|---|---|---|
| 347326 | 1/1922 | Fed. Rep. of Germany | 273/61 R |
| 2527458 | 12/1983 | France | 273/61 A |
| 9786 | of 1899 | United Kingdom | 273/58 BA |

*Primary Examiner*—George J. Marlo

*Attorney, Agent, or Firm*—Pennie & Edmonds

[57] ABSTRACT

A ball, for example a tennis ball, comprises a hollow resilient shell having a non ferromagnetic conductive layer interior of the shell. The conductive layer is preferrably aluminum and is held in place against an inner wall of the shell by an internal resilient mass. An eddy current can be induced in the layer when the ball passes through an oscillating field rendering the balls passage detectable. The metal layer is preferably not adhered to the shell and is resiliently biased against the shell interior side.

13 Claims, 3 Drawing Figures

LINE FAULT DETECTOR BALL

TECHNICAL FIELD OF THE INVENTION

This application is a divisional application of U.S. Ser. No. 519,772, filed June 30, 1983, now U.S. Pat. No. 4,664,376.

The invention relates to a sports ball for use with electronic ball detection systems.

The invention will herein be described with particular reference to a tennis ball, but it will be understood that the invention is applicable to other ball games and is not limited to use for tennis.

BACKGROUND ART

As is well known, tennis is played on a court marked with lines. When a ball bounces on or close to certain of the lines an umpire must rule on whether the ball is within a designated area bounded by the lines, and hence in-play ("in") or is out-of-play ("out"). Because the tennis ball may be travelling at high speed, it is often difficult to judge by eye whether the ball is "in" or "out". When tennis is being played professionally the umpires rulings may have considerable importance for players and/or sponsors.

A number of systems have been proposed for automatically detecting whether a tennis ball is "in" or "out". Most such systems utilize a tennis ball which is provided with a conductive outer surface. A plurality of closely spaced parallel exposed electrical conductors extend on and/or adjacent the lines and along the full length thereof. Contact of the conductive outer surface of the ball with adjacent conductors completes an electrical circuit. If the conductors of the circuit completed by the ball are within an "in" area of the court the apparatus signals the ball is "in". Such systems are exemplified in U.S. Pat. Nos. 3,883,860 and 1,370,333.

Tennis balls having an electrical conductive exterior for use in those systems are described in U.S. Pat. Nos. 1,580,360, 4,299,384, 4,299,029, 4,071,242, and 3,854,719.

Systems dependant on conductive connection between exposed conductors on the court surface are susceptible to failure as a result of resistive corrosion either of the conductors of the court or of the ball, or covering of the conductors by insulators such as dirt and to failure as a result of short circuits for example by moisture. Moreover the balls do not behave as do normal tennis balls or cause undue wear of racquets or the conductive surface of the ball fails as a result of wear prematurely in the ball life.

In U.S. Pat. No. 3,774,194 there is described a system which does not require exposed conductors. Instead a receiving antenna wire extends longitudinally of a court line and is buried beneath the line. There is provided a radio transmitter and a ball containing three coils at right angles acting as a resonant circuit tuned to the radiofrequency of the transmitter. The ball when in the vicinity of the court antenna acts as a coupler causing vertically polarised radiowaves from the transmitter to be sensed in the horizontal court antennae. In another embodiment a ball having a ferromagnetic metal or metal oxide included in the rubber composition thereof disturbs the resonant tuning of transmitter and receiver or the capacitance of a thin layer of metal deposited on the outer surface of the rubber ball beneath a felt outer-layer is used to unbalance a balanced capacitance bridge circuit.

That system is subject to interference by external signals and the balls required for use in the system do not have the properties of normal tennis balls and are expensive to manufacture.

None of the systems so far proposed has won wide acceptance and there is a continuing need for a satisfactory ball for use in detection systems.

An object of the present invention is to provide a ball which avoids at least some of the previously discussed disadvantages.

DISCLOSURE OF THE INVENTION

According to one aspect the invention consists in a a ball for use with an electronic detection apparatus said ball comprising:

a resilient shell having interior thereof, a non ferromagnetic conductive layer in which an eddy current can be induced by passage of the ball through an oscillating field.

By way of example only an embodiment of the invention will now be described with reference to the accompanying drawings wherein:

PREFERRED EMBODIMENT OF THE INVENTION

Figure 1:
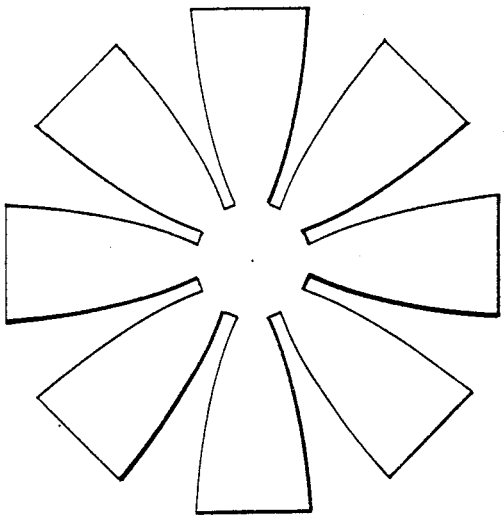
FIG. 1 is a schematic diagram of a tennis ball according to the invention.

With reference to FIG. 1 there is shown a preferred embodiment of the present invention comprising a tennis ball 1 consisting in a rubber hollow spherical shell 2 provided, on the shell external surface, with an outer cover or flock 3 in the manner usual for tennis balls.

A non ferromagnetic conductive sheet material 5 is provided adjacent the inner surface of shell 2. For preference the conductive sheet 5 is a metal foil formed into an approximately spherical shape so that when the ball passes through an oscillating field an eddy current is induced in the metal foil, and a change in the oscillating field caused by eddy current loss, is detectable.

Figure 2:
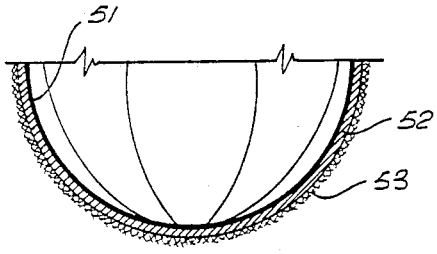
FIG. 2 is a schematic diagram of a half tennis ball in cross-section containing a metal foil lining according to the invention.
Figure 3:
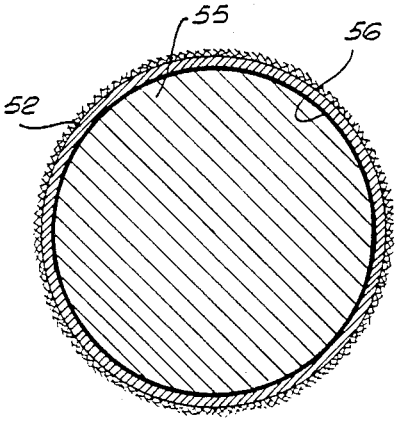
FIG. 3 is an aluminium foil shape prior to moulding into a hemispherical ball insert.

In one method of making a tennis ball according to the invention two rubber hemisphere shells 22 as shown in FIG. 2 are formed. Metal foil stampings 31 such as shown in FIG. 3 and comprising a central disk portion 32 with radially extending leaves 33 are cut from aluminium foil. A stamping 31 is configured to conform with the interior surface of a hemispherical shell 22 to form a foil hemispherical shape 23. For preference each leaf 33 overlaps with its neighbour at adjacent edges 34.

Two hemispherical shells 22 each lined with a foil hemispherical shape 23 may then be connected to form a tennis ball having a hollow metal foil sphere or pair of hemispheres interior of the ball. It has been found in practice to be preferable to urge the metal foil shape 23 against the interior surface of ball rubber shell 22. If the foil is adhered to the rubber shell, flexing during use results in a cracking of the metal foil. However if a resilient mass 4 is contained in the interior of the ball and the metal foil is interposed between the resilient mass and the rubber shell so as to be urged against the interior surface of the rubber shell, then the foil has a much longer service life. The resilient mass may be a compressible resilient plastics material such as a polyurethane foam and may be formed into hemispheres one being inserted in each hemispherical shell 22 after inserting the aluminium foil stamping 31. The metal foil is thus lightly but resiliently pressed against the interior side of rubber shell 22 in the finished ball.

In another embodiment a gas inflated bladder is used instead of a compressible foam to press the foil 23 against the shell interior side.

If the resilient mass 4 is an inflated bladder, the bladder may be inflated prior to surrounding the bladder with the outer case halves and then fusing or welding the outer case halves together or otherwise moulding the outer case around the bladder and metal.

If preferred the bladder may contain a substance which evolves gas, for example upon being heated, and in that event the bladder may be enclosed in the outer case with the metallic component and subsequently caused to inflate and to press the metallic component against the outer case. During vulcanization the chemicals inside the bladder react to liberate a gas. A suitable composition is a pellet of ammonium chloride and a pellet of sodium nitrite together with 1 c.c. of water, which is a system well known in the art of pressurizing tennis balls. Other chemicals which can be used are: sodium bicarbonate, which loses $CO_2$ at 270°, or sodium bisulfite which loses $SO_2$ on decomposition, or sodium carbonate peroxide which decomposes at 100° C. The non-gaseous residue in each case becomes uniformly distributed on the inside of the bladder as a powder.

In another embodiment the resilient mass may consist of a plastics mass which contains a foaming or blowing agent and which is allowed to expand for example upon heating to form a resilient foam.

When aluminium foil is used as the metallic component in a tennis ball it has been found preferable to use a thin foil for example 1 to 20 microns, more preferably of from 5 to 9 microns in thickness. Foils having a thickness less than 20 microns are detectable while having sufficient flexibility and durability.

It has been found to be particularly advantageous to use an aluminium foil having a polyester film laminated on one side and a polypropylene film laminated on the other. Such laminated foil has a good shape recovery and yet is resistent to cracking. The laminate has been found to provide detectable eddy current losses while being of sufficiently lightweight as not to interfere with performance characteristics of the ball. Conductive materials other than aluminium can be used but aluminium is preferred because of its flexstrength to weight ratio.

Metal foils may be formed into a hemispherical, spherical, or other suitable shape by means other than that shown in FIG. 3. For example the metal may be formed directly into a hemispherical shape by various forming techniques. If foil hemispheres are used, it is not necessary that foil in one hemisphere overlaps with that in the other. A ball having a non conductive equatorial gap of 2 or 3 millimeters remains easily detectable in all orientations. While a generally spherically shaped conductive layer is preferred it is not essential.

The conductive layer need not be a foil but may be a wire mesh, a metal wool such as a "steel wool", or a metallic powder, or may be a deposited metallic film provided in each case that the composition is selected so that eddy currents may be induced therein when the ball passes through an oscillating field. It will be understood that in general a foil or sheet material is most suitable from a conductivity viewpoint.

In preferred embodiments the conductive layer is resiliently held against the outer wall and the tennis ball is deformable as required for play, the metallic layer being otherwise substantially immobilized so as to avoid alteration to the characteristics of the ball during flight. When used with a detection system such as described in pending U.S. Ser. No. 519,772 balls such as herein described have many advantages over prior art. The system is capable of sensing a ball travelling at high speed and is relatively free from extraneous influence. The system is sensitive not only to proximity to a boundary but if desired may identify particular linear sections of the boundary distinguishing one part from another. Preferred embodiments of balls according to the invention perform more like a normal ball than do balls intended for use with prior art detection systems.

The system may be used in other games, for example in table tennis, or playing-field ball games and the balls of those games may be adapted in a manner similar to that described herein in relation to tennis balls.

I claim:

1. A tennis ball for use with an electronic detection apparatus, said tennis ball comprising:

(a) a resilient shell having an interior wall, (b) a thin flexible aluminum conductive layer concentric with said resilient shell and in contact with said interior wall said conductive layer flexing resiliently with said resilient shell and in which an eddy current is induced by passage of the ball through an oscillating field.

2. A ball according to claim 1 wherein the conductive layer is of a substantially spherical configuration whereby an eddy current can be induced therein in most or all of orientations of the ball.

3. A ball according to claim 2 wherein the interior conductive layer is a metal foil.

4. A ball according to claim 3 wherein the foil has a thickness of from 1 to 20 microns and is urged against the interior surface of the hollow shell by means of a resilient defined mass contained within the case.

5. A ball according to claim 1 wherein the conductive layer is interposed between a resilient mass and the interior surface of the hollow shell.

6. A ball according to claim 5 wherein the resilient mass is a plastics foam.

7. A ball according to claim 5 wherein the resilient mass is an inflated bladder.

8. A ball according to claim 5 wherein the conductive layer is a metal foil.

9. A ball according to claim 5 wherein the conductive layer is aluminium foil.

10. A ball according to claim 5 wherein the conductive layer is a metal wool.

11. A ball according to claim 5 wherein the conductive layer is a metal mesh.

12. A ball according to claim 5 wherein the conductive layer is a metal powder.

13. A ball according to claim 1 wherein the conductive layer is of a substantially spherical configuration, whereby an eddy current can be induced therein in most or all orientations of the ball, and includes a metal foil stamping, having a central disk portion and at least one radially extending leaf, that is configured to conform with the interior wall to form a hemispherical shape.

* * * * *